United States Patent [19]

Kurschatke

[11] Patent Number: 4,774,747

[45] Date of Patent: Oct. 4, 1988

[54] GAS BURNER FOR THE INTERIOR HEATING OF HOLLOW ROLLS

[75] Inventor: Wolfgang Kurschatke, Krefeld, Fed. Rep. of Germany

[73] Assignee: Eduard Küsters, Krefeld, Fed. Rep. of Germany

[21] Appl. No.: 826,109

[22] Filed: Feb. 5, 1986

[30] Foreign Application Priority Data

Mar. 14, 1985 [DE] Fed. Rep. of Germany ..... 3509104

[51] Int. Cl.[4] ..... D06B 23/02; D21G 1/02; F26B 13/18

[52] U.S. Cl. ..... 29/110; 72/200

[58] Field of Search ..... 29/110; 26/3; 165/89; 72/200, 202; 239/436, 553.3, 563, 581.1, 581.2, 597

[56] References Cited

U.S. PATENT DOCUMENTS

| | | | |
|---|---|---|---|
| 654,470 | 7/1900 | Mather | 165/89 X |
| 1,776,545 | 9/1930 | Carrington | 239/563 X |
| 1,982,571 | 11/1934 | Clark | 72/200 X |
| 2,064,182 | 12/1936 | Spence et al. | 72/202 |
| 2,228,114 | 1/1941 | Hess | 431/266 |
| 2,319,309 | 5/1943 | Emigh | 72/200 X |
| 3,182,587 | 5/1965 | Woodhall | 29/110 X |
| 3,295,593 | 1/1967 | Wentzel | 165/89 X |
| 3,331,434 | 7/1967 | Lockhart | 29/110 X |
| 3,448,498 | 6/1969 | Sando et al. | 26/3 |
| 3,565,347 | 2/1971 | Denninger et al. | 239/563 X |
| 4,332,063 | 6/1982 | Ehrhardt | 26/3 |
| 4,466,574 | 8/1984 | Dobson et al. | 239/597 X |
| 4,508,274 | 4/1985 | Eichfeld et al. | 239/563 X |
| 4,641,403 | 2/1987 | Osthoff et al. | 26/3 |

FOREIGN PATENT DOCUMENTS

| | | | |
|---|---|---|---|
| 1561706 | 10/1970 | Fed. Rep. of Germany . | |
| 2847029 | 11/1980 | Fed. Rep. of Germany . | |
| 139221 | 8/1982 | Japan | 239/563 |
| 60-29776 | 7/1985 | Japan | 26/3 |
| 647034 | 12/1950 | United Kingdom . | |
| 855469 | 11/1960 | United Kingdom . | |
| 2106236 | 11/1984 | United Kingdom . | |
| 2105026 | 3/1985 | United Kingdom . | |

*Primary Examiner*—E. Michael Combs
*Attorney, Agent, or Firm*—Kenyon & Kenyon

[57] ABSTRACT

A gas burner includes a burner tube which has on one side a row of burner nozzles aimed against a surface to be heated. In the interior of the burner tube, at least one slider is arranged which can be moved from outside the burner tube along the tube and by means of which the end burners of the row of burner nozzles can be shut off from the gas supply which is supplied the center of the burner tube, so that the row of the burner nozzles can be adapted to the width of the surface to be heated, e.g., to the width of a web when the burner tube is used to heat a hollow roll used to treat a web.

11 Claims, 2 Drawing Sheets

GAS BURNER FOR THE INTERIOR HEATING OF HOLLOW ROLLS

BACKGROUND OF THE INVENTION

This invention relates to gas burners in general and more particularly to a gas burner for the interior heating of hollow rolls.

If a gas burner is used for the heating of a roll, the burner nozzle tube typically extends through the interior of the hollow roll and is supplied from the end with gas, in particular a fuel gas/air mixture. The burner nozzles are mounted on the outside of the burner nozzle tube with relatively little mutual longitudinal spacing in a lengthwise region of the burner nozzle tube which corresponds approximately to the width range of the web to be processed. Since the burner nozzle tube is stationary and the hollow roll rotates about the burner nozzle tube, temperature equalization is obtained in the circumferential direction. However, the temperature equalization at the ends of the row of burner nozzles is a problem if their length does not agree with the width of the web. If burner nozzles are still in operation outside the edge of the web in the interior of the hollow roll, the edge region of the hollow roll is heated more than the region in the middle because there is no longer a web opposite the edge region which removes heat continuously. Therefore, the temperature rises at the edge. If, however, the region covered by the burner nozzles is narrower than the web, the edge of the web removes heat on the outside in a region in which no heat is replenished from the inside and, in this case, the temperature drops toward the edges of the web.

It is, thus, an object of the present invention to develop a gas burner having active length, i.e., the region in which operating burner nozzles are present, which can readily be adapted to changing web widths.

SUMMARY OF THE INVENTION

According to the present invention, this problem is solved by providing a gas feed opening into the interior of the burner tube and providing a slider sealed against the inside of the burner tube in the region of at least one end, the slider movable from outside so that the burner nozzles at the end of the burner tube may be shut off.

The row of burner nozzles at the burner tube is selected to correspond to the greatest operating width, i.e., in the case a hollow roll is to be heated, to the greatest web width to be processed on the hollow roll. The slider is then inserted so far that it is located approximately in the region of the web edge. The burner nozzles located furthest out are shut off from the gas supply by the slider and, therefore, are not lighted. Normally, one slider will be provided in the vicinity of each end of the row of burner nozzles. In this manner the heated width can be adapted to the width of the web without difficulty, whereby not only the temperature uniformity over the web width is promoted, but also considerable savings of power costs are achieved.

Sliders for limiting supply widths are known per se in the field of rolls, although for different purposes. In DE-OS No. 15 61 706, the hollow roll is supported on a stationary core and braced against the inside by hydraulic pressure-exerting devices aimed in the plane of action of the roll toward both sides. Between the pressure chambers of the pressure-exerting devices, several transverse canals are arranged one behind the other in the direction of the axis, of which more or fewer can be shut off depending on how far the slider which interrupts the transverse canals is inserted in the direction of the axis. From German Patent No. 28 47 029, sliders at a similar roll are known which are arranged in a longitudinal hole of the stationary cross piece and are inserted only during the assembly, but are stationary in operation. They serve for bounding supply spaces for hydraulic pressure liquid which is to be alotted to pressure plungers arranged in a row one behind the other along the roll.

In one practical embodiment of the sliders, a rod is used to control the displacement and at the same time to give a simple indication of the position of the slider hidden in the burner tube.

The preferred embodiment of the gas feed includes a gas supply tube which extends parallel to the burner tube with a small spacing thereto and coupled to the burner tube via at least one transverse passage. Arranging the gas supply tube on the side of the burner tube removed from the row of burner nozzles contributes to the protection of the gas feed tube from being excessively heated by radiation.

So that no appreciable pressure drop occurs along the burner tube, several transverse passages with mutual lengthwise spacing may be provided.

Connecting the burner tube and gas supply tube only in the region of the transverse passages reduces the tendency of the two tubes, which are rigidly connected to each other via the transverse passages, to get warped, as could be expected if they were, for instance, welded to each other lengthwise. The free ends of the gas feeding tube or the burner tube can expand essentially freely, so that no substantial forces acting in the flexure mode can be generated. The transverse passages, advantageously comprise tube nozzles.

Having the burner tube and gas supply tube extend through the entire hollow roll and extend from both ends, likewise contributes to increasing the uniformity of the thermal conditions. The heat removal by the gas burner itself is uniform along the hollow roll in this manner.

The adjustment of the slider can also be automated by using a control device, embodiments including temperature sensors and edge controls for positioning the sensors being practical. The present invention also covers the method of adjustment using the apparatus of the present invention in which the heated width and the web width need not agree. The heated width is adjusted so that the roll has uniform temperature over the width of the web.

DETAILED DESCRIPTION

Figure 1:
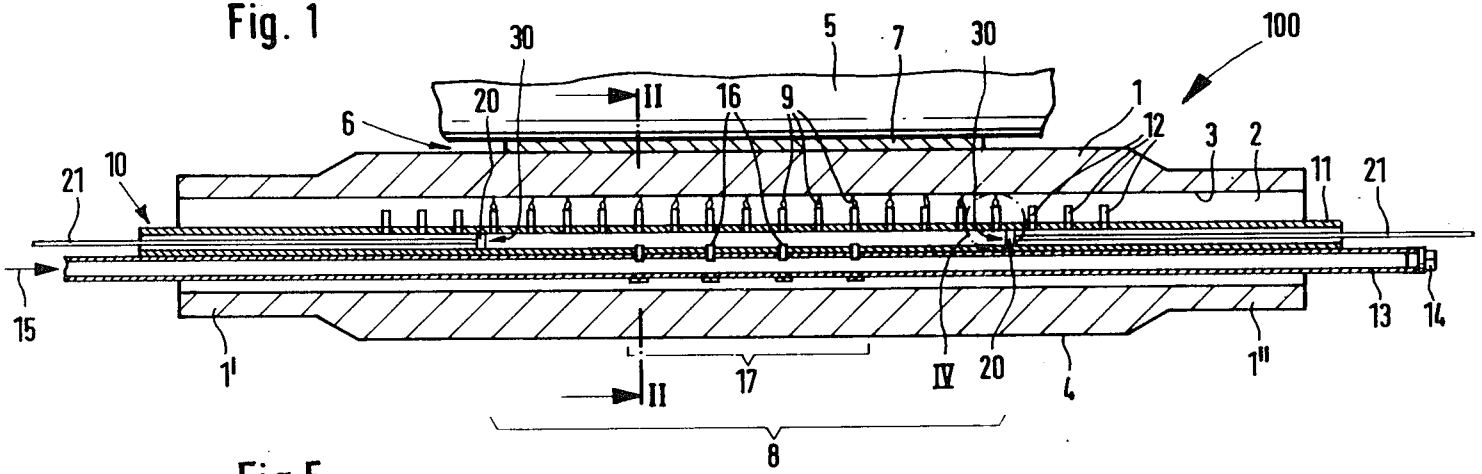
FIG. 1 is a longitudinal section through a gas burner according to the present invention extending through a hollow roll.

The roll 100 of FIG. 1 comprises a hollow roll 1 with a through hole 2, in which a gas burner 10 is arranged which heats the inside circumference 3 of the through hole 2. The hollow roll 1 has a working outside circumference 4 which, with counter roll 5, only indicated, forms a rolling gap 6 for processing a web of material 7. The web of material 7 is processed at an elevated temperature of the outside circumference 4 of the hollow roll 1, and this elevated temperature is generated by the gas burner 10.

The gas burner 10 comprises a burner tube 11 which protrudes at the ends 1' and 1" thereof which serve for supporting the hollow roll 1. At the burner tube 11, a row of burner nozzles 12 is arranged. Burner nozzles 12 which have a longitudinal spacing from each other which is small as compared to the length of the hollow roll 1 and are screwed into the outside circumference of the burner tube 11 along a straight cylindrical surface 9 thereof parallel to the axis. The design of the burner nozzles 12 can be seen in FIG. 2. The spacing of the burner nozzles 12 in the longitudinal direction of the burner tube 11 is designed so that no temperature differences relevant with respect to the treatment of the web of material adjust themselves at the outside circumference 4 of the hollow roll 1.

Parallel to the burner tube 11 extends a gas feeding tube 13 which likewise protrudes from the hollow roll 1 at both ends and is closed by a plug 14 at the right end in FIG. 1. A gas-air mixture is supplied to it at the left end as indicated by the arrow 15.

The connection between the gas feeding tube 13 and the burner tube 11 takes place at transverse passages 16, of which four are present in the illustrated embodiment; they are arranged over a central region 17 of the length of the hollow roll 1. The length of the region 17 amounts, in the illustrated embodiment, to only about 20% of the total length of the hollow roll 1.

The connection between the gas feeding tube 13 and the burner tube 11 takes place at transverse passages 16 formed by tubular nozzles 18 which are screwed into the burner tube 11 as well as into the gas feeding tube 13. They form, at the same time, the gas passage between the two tubes 13 and 11 and the only mechanical connection between them. In the longitudinal section outside of the region 17, the tubes 11 and 13 are, therefore, not connected to each other and are free.

At the height of the tubular nozzles 18, holes with plugs 19 are provided on the opposite side of the gas feeding tube 13. The holes are used only for assembly purposes and are to facilitate access to the tubular nozzles 18.

Figure 2:
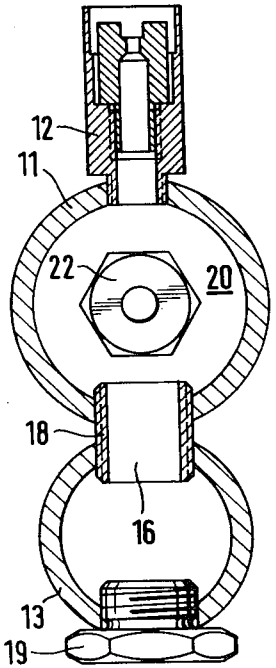
FIG. 2 is a cross section through the gas burner along the line II—II in FIG. 1.

As can be seen from FIGS. 1 and 2, the burner nozzles 12 are located on the side of the roll gap 6 and the gas feeding tube 13 is arranged in the plane of action on the opposite side of the burner tube 11. The plugs 19 are located on the side of the gas feeding tube 13 facing away from the tubular supports 18.

The gas burner 10 is fixed and the hollow roll 1 rotates around the gas burner 10.

As can be seen from FIG. 1, the web of material 7 is narrower than the crown of the hollow roll 1 forming the working roll circumference 4 in the illustrated embodiment. If all burner nozzles 12 were in operation, the hollow roll 11 would be heated in regions which are located laterally outside the edge of the web 7 and in which no continuous heat removal by the web 7 is provided. These regions would then be heated heavily and because of the heat conduction, the temperature rise would also be noticeable at the edge of the material web 7. Such a temperature rise toward the edge leads to a nonuniformity of the thickness because the hollow roll 1 is thicker in the outer regions due to the higher temperature.

A logically similar situation applies to the case that the web 7 is wider than the region covered by the burner nozzles 12.

In order to prevent such temperature nonuniformities, the row of burner nozzles 12 is as long as the working part of roll 1 having the full working circumference, i.e., as long as the maximum possible width of the web of material. If the web 7 is narrower, the outer burner nozzles 12 are shut off by shutting off the gas supply. The burner nozzles 12 are in operation only in a region 8 which will be designated as the heating width, as is indicated by the flames 9.

The shutting off of the outer burner nozzles 12 from the gas supply is accomplished by sliders 30 which comprise two disc-shaped or cylindrical pistons 20 which are each connected to a rod 21 which extends to the outside and protrudes from the end of the burner tube 11. At the end, the rod 21 has a thread, goes through the circular disc-shaped piston 20 and is secured at the piston 20 by means of a nut 22 screwed onto the other slot, in which a seal 24, which seals against the inside circumference 23 of the burner tube 11 is arranged.

Since gas is supplied only in the central region 17 via transverse passage 16, the gas can spread along the burner tube 11 only up to the sliders 30 and supply only the burner nozzles 12 there. The sliders 30 are inserted approximately far enough that their position corresponds to the position of the edge of the web 7 just processed. This position can be indicated by markings arranged at the rod 21.

If the requirements are low, one can leave it at such an adjustment. If the requirements are more stringent, however, the effect of limiting the heating width must be controlled. This is accomplished by temperature sensors 26, 27 and 28 (FIG. 5) which measure the temperature of the roll surface in the region of the web edges and in the center of the web, respectively. If the temperature measured by one of the temperature sensors 26 or 28 is lower than that of the temperature sensor 27, the slider 30 of the respective web edge must be pulled out slightly more so that one or more additional burner nozzles 12 are also activated and somewhat more heat is supplied on the side in question.

From this, it can be seen that the heating width 8 (FIG. 1) generally does not agree with the web width 25 (FIG. 5) but must be chosen somewhat larger than the web width 25 so that the temperature is constant over the web width 25. The amount by which the heating width must be chosen larger, differs individually and depends on the ratio of the web width 25 to the length of the roll 1, on the nature of the web of material 7, on the operating speed and on the temperature level.

If the temperature profile is measured by the temperature sensors 26, 27 and 28, a first step is again the manual adjustment of the sliders 30 at the rods 21 until constant temperature over the web width 25 is achieved.

Figure 5:
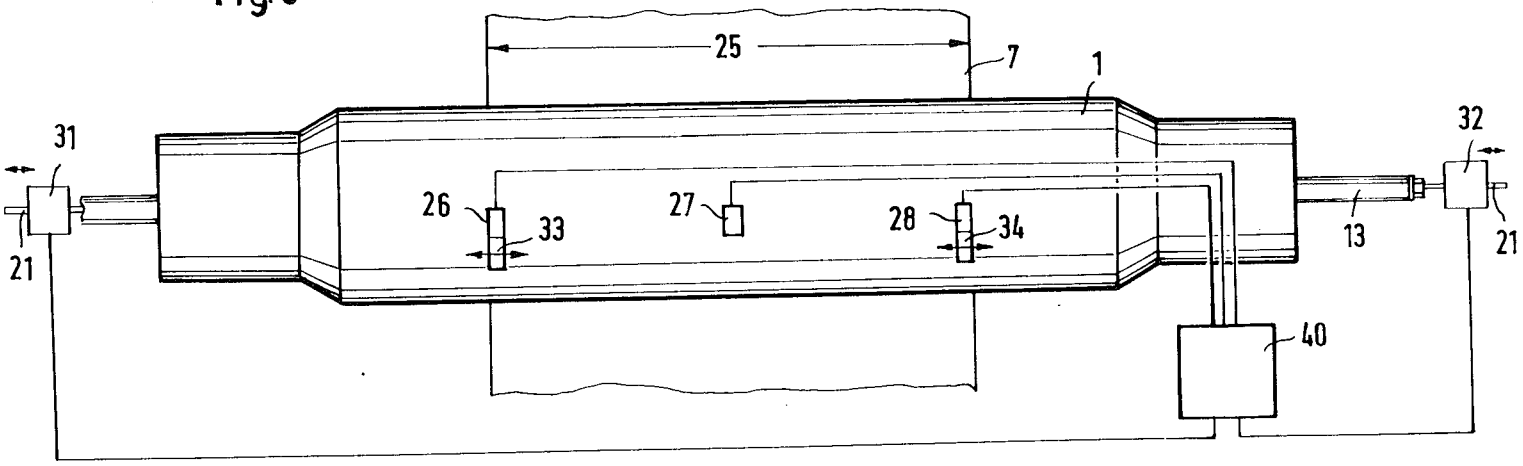
FIG. 5 is a view from below corresponding to FIG. 1, of an automated embodiment.
Figure 4:
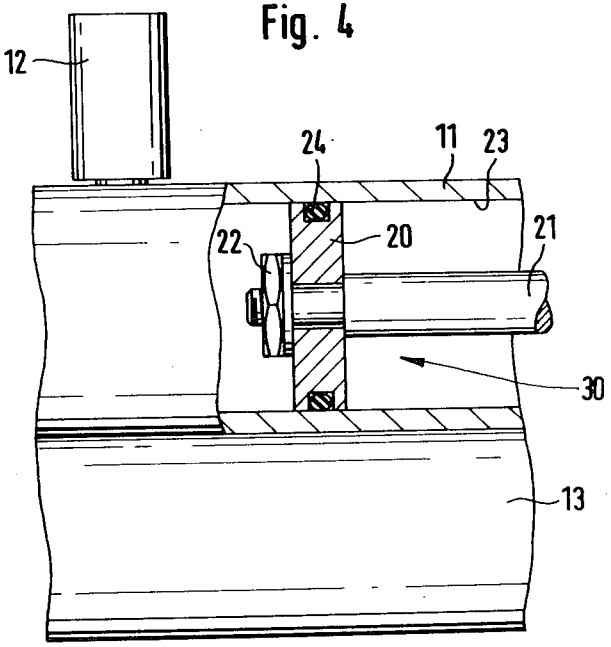
FIG. 4 is a corresponding side view of the part of the gas burner located in the circle IV in FIG. 1.
Figure 3:
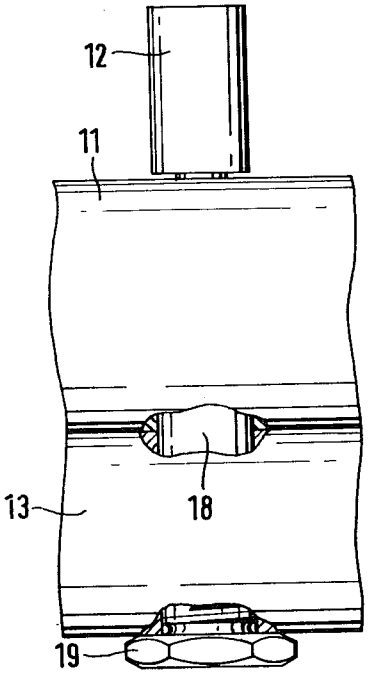
FIG. 3 is a partial side view according to FIG. 2 from the left.

A further step, however is an automatic servo system using control members 31 and 32, e.g., linear actuators, which engage the rods 21 and displace the rods 21 in the directions of the arrows (FIG. 5). The control members 31 and 32 receive inputs from a control unit 40 which processes the signals of the temperature sensors 26, 27 and 28, and, in the event of a deviation of the temperature of one of the outer temperature sensors 26 or 28 from the center temperature, operates the respective control member 31 or 32 and adapts the position of respective edge of the heating width 8 until a constant temperature is provided.

The automation can be pursued still further if the outer temperature sensors 26 and 28 are fastened to web edge discs 33 and 34 which follow the edge of the web and position the respective temperature sensor automatically to the new position of the web edge when the position of the web edge changes.

A simplified alternative control possibility consists of always adjusting the sliders 30 automatically to the web edge by means of the control members 31 and 32 without measuring the actual temperature. Possible differences between the heating width 8 required for reaching constant temperature and the web width 25 are not taken into consideration here, however.

The illustrated embodiment shown relates to a roll 100 which is provided for treating textile webs for the purpose of densification and generation of sheen as is required, for instance, in the manufacture of chintz. Especially in the textile sector, very different web widths occur most frequently. The finishing shops often deal with moderate footages of different quality, design or manufacturers, so that then, adapting the heating width 8 is actually an important problem. With the device shown, one operates at surface temperatures of the roll 1 which, for instance, in the solidification of nonwoven fabrics, are up to 245° C. and in the treatment of texile material up to 235° C. The operating speeds are about up to 150 m/min and predominantly about 80 m/min. The temperature actually reached also depends, of course, on the working speed and the nature of the web of material due to the heat removal by the web of material.

What is claimed is:

1. A hollow roll for treating a web of material, said hollow roll having an outer working circumference forming part of a rolling gap for processing the web, an inner circumference and a gas burner comprising:

a. a burner tube extending through the hollow roll along one side of the inner circumference to be heated, said burner tube having a row of burner nozzles parallel to the axis of the burner tube aimed against said one side;

b. a gas feed tube having ends protruding from said hollow roll with one of the ends having a gas supply connection, said gas feed tube extending parallel to the burner tube with a small lateral spacing therefrom;

c. at least one transverse passage defining a central supply path for gas to enter the burner tube, said passage connecting said gas feed tube to said burner tube only in the central region of said burner tube, whereby the free ends of said tubes are free to expand essentially independently thereby reducing the tendency of the tubes to warp; and d. at least one slider sealed to the inside circumference of the burner tube disposed within the burner tube in the region of at least one end of said row of burner nozzles; and e. means to move said at least one slider from outside the burner tube along the inside of the burner tube whereby burner nozzles located toward the end of the row of burner nozzles can be shut off from the gas supply coming from the central supply path.

2. A hollow roll according to claim 1, wherein said slider comprises a piston and a rod connected thereto, said rod protruding from the end of the burner tube.

3. A hollow roll according to claim 1, wherein said gas feed is arranged on the side of the burner tube opposite the row of burner nozzles.

4. A hollow roll according to claim 1, wherein several transverse passages with mutual lengthwise spacing are provided in the central region of the row of burner nozzles.

5. A hollow roll according to claim 4, wherein said transverse passages are formed by short tubular nozzles engaging the burner tube and the gas feed.

6. A hollow roll according to claim 1 wherein sliders are provided at both ends of said burner tube.

7. A hollow roll according to claim 1 and further including a control device by means of which said slider can be adjusted automatically to maintain a uniform temperature across the portion of the inner circumference adjacent the width of a web lying on the outer working circumference of the hollow roll.

8. A hollow roll according to claim 7, wherein the control device comprises temperature sensors arranged in the region of the center of the web and in the region of the web edges for determining the roll temperature.

9. A hollow roll according to claim 7, wherein control device further comprises web edge controls by means of which the temperature sensors are slaved in accordance with the position of the web edges.

10. A hollow roll in accordance with claim 1 wherein said central region of said burner tube comprises about 20% of the length of said burner tube.

11. In a hollow roll having an outer working circumference for treating a web of material heated by a gas burner comprising a burner tube having on one side a row of nozzles directed against the inside of the hollow roll, a gas feed coupled to the central area of said burner tube and sliders, one at each end of said burner tube for controlling the supply of gas to nozzles at the ends of said burner tube, a method for controlling the position of said sliders to maintain a uniform temperature across the portion of the inside of the hollow roll adjacent the width of a web lying on the outer working circumference of the hollow roll comprising:

a. sensing the temperature in a region of the roll corresponding to the web edge;

b. in the event of a drop of the temperature, pulling the slider out more relative to the central region of the roll; and c. in the event of a temperature rise, inserting said slider further relative to said central region.

* * * * *